US008753156B2

(12) United States Patent
Ketterman et al.

(10) Patent No.: US 8,753,156 B2
(45) Date of Patent: Jun. 17, 2014

(54) REMOTE DRIVE

(75) Inventors: Gregory S. Ketterman, Oceanside, CA (US); James T. Czarnowski, Oceanside, CA (US); Jason Christopher Kardas, Vista, CA (US)

(73) Assignee: Hobie Cat Company, Oceanside, CA (US)

( * ) Notice: Subject to any disclaimer, the term of this patent is extended or adjusted under 35 U.S.C. 154(b) by 105 days.

(21) Appl. No.: 12/704,454

(22) Filed: Feb. 11, 2010

(65) Prior Publication Data

US 2010/0203778 A1 Aug. 12, 2010

Related U.S. Application Data

(60) Provisional application No. 61/207,715, filed on Feb. 12, 2009.

(51) Int. Cl.
*B63H 16/20* (2006.01)
*B63H 21/17* (2006.01)
*B63H 25/42* (2006.01)

(52) U.S. Cl.
USPC ..... 440/26; 440/6; 440/51

(58) Field of Classification Search
CPC ..... B63H 20/34; B63H 16/12; B63H 25/42; B63H 16/14; B63H 16/20; B63H 5/125
USPC ..... 114/62, 347, 144 R, 162, 61.1, 61.22; 440/6, 13, 14, 15, 19, 21, 24, 25, 26, 440/29, 51, 53
See application file for complete search history.

(56) References Cited

U.S. PATENT DOCUMENTS

| | | | | |
|---|---|---|---|---|
| 35,451 | A | 6/1862 | Johnson | |
| 1,826,507 | A * | 10/1931 | Crosby | 440/30 |
| 2,158,349 | A * | 5/1939 | Allen | 74/136 |
| 2,286,914 | A | 3/1941 | Knapp | |
| 2,873,713 | A | 12/1955 | Baastrap | |
| 2,948,255 | A | 8/1960 | Sbrana | |
| 3,032,001 | A | 8/1960 | Kiker, Jr. | |
| 3,095,850 | A | 7/1963 | Stolzer | |
| 3,211,125 | A * | 10/1965 | Yarbrough | 440/28 |
| 3,695,211 | A | 10/1972 | Gross | |
| 3,828,719 | A | 8/1974 | Cooke | |
| 4,318,700 | A | 3/1982 | Price | |
| 4,474,502 | A | 10/1984 | Daoud | |
| 4,490,119 | A * | 12/1984 | Young | 440/14 |
| 4,511,338 | A | 4/1985 | Fanelli | |

(Continued)

FOREIGN PATENT DOCUMENTS

| | | |
|---|---|---|
| GB | 174017 A | 1/1922 |
| GB | 452719 | 8/1936 |

(Continued)

OTHER PUBLICATIONS

Howe, Peter J., "Penguin Power Bids to Challenge the Propeller", The Boston Globe, May 12, 1997, p. C1.

*Primary Examiner* — Lars A Olson
*Assistant Examiner* — Andrew Polay
(74) *Attorney, Agent, or Firm* — Joseph E. Mueth

(57) ABSTRACT

A remote powered propulsive device having a rudder which carries a propeller or oscillating fins which are powered by pedals alone or with hydraulic assist or by an electric motor.

15 Claims, 21 Drawing Sheets

(56) References Cited

U.S. PATENT DOCUMENTS

| | | | | | |
|---|---|---|---|---|---|
| 4,648,846 | A | | 3/1987 | Hsu | |
| 4,676,755 | A | | 6/1987 | Yagan | |
| 4,688,815 | A | * | 8/1987 | Smith | 280/216 |
| 4,891,024 | A | | 1/1990 | Benjamin | |
| 4,936,802 | A | | 6/1990 | Ueno | |
| 4,943,251 | A | * | 7/1990 | Lerach et al. | 440/28 |
| 4,960,396 | A | | 10/1990 | Stolzer | |
| 4,968,274 | A | | 11/1990 | Gregory | |
| 5,021,015 | A | | 6/1991 | Wang | |
| 5,090,928 | A | * | 2/1992 | Rybczyk | 440/24 |
| 5,183,422 | A | | 2/1993 | Guiboche | |
| 5,194,024 | A | | 3/1993 | Shiraki | |
| 5,295,927 | A | | 3/1994 | Easley et al. | |
| 5,453,031 | A | | 9/1995 | Gagnier | |
| 5,460,551 | A | | 10/1995 | Beres | |
| 5,580,288 | A | | 12/1996 | Marinc | |
| 5,584,732 | A | | 12/1996 | Owen | |
| 5,643,020 | A | | 7/1997 | Harris | |
| 6,022,249 | A | | 2/2000 | Ketterman | |
| 6,077,134 | A | | 6/2000 | Lam | |
| 6,112,692 | A | * | 9/2000 | Lekhtman | 114/347 |
| 6,165,029 | A | | 12/2000 | Lu | |
| 6,165,030 | A | | 12/2000 | Lewis | |
| 6,210,242 | B1 | * | 4/2001 | Howard et al. | 440/21 |
| 6,478,639 | B1 | * | 11/2002 | Covell, III | 440/6 |
| 6,855,016 | B1 | * | 2/2005 | Jansen | 440/6 |
| 6,905,379 | B1 | | 6/2005 | Jackson | |
| 6,997,765 | B1 | | 2/2006 | McGuinness | |
| 7,371,138 | B2 | | 5/2008 | Spass | |
| 7,430,976 | B2 | | 10/2008 | Ketterman et al. | |
| 7,549,902 | B2 | * | 6/2009 | Jansen | 440/27 |
| 7,637,791 | B2 | | 12/2009 | Ketterman et al. | |
| 8,167,667 | B2 | * | 5/2012 | Sturm | 440/21 |
| 2008/0293312 | A1 | | 11/2008 | Scott | |
| 2009/0198395 | A1 | * | 8/2009 | Winsky et al. | 701/21 |
| 2011/0287674 | A1 | * | 11/2011 | Jemt | 440/15 |

FOREIGN PATENT DOCUMENTS

| | | |
|---|---|---|
| JP | 52-033290 | 3/1977 |
| JP | 01-144198 | 10/1989 |
| JP | 03-035897 | 4/1991 |
| WO | WO 99/61306 A1 | 12/1999 |

* cited by examiner

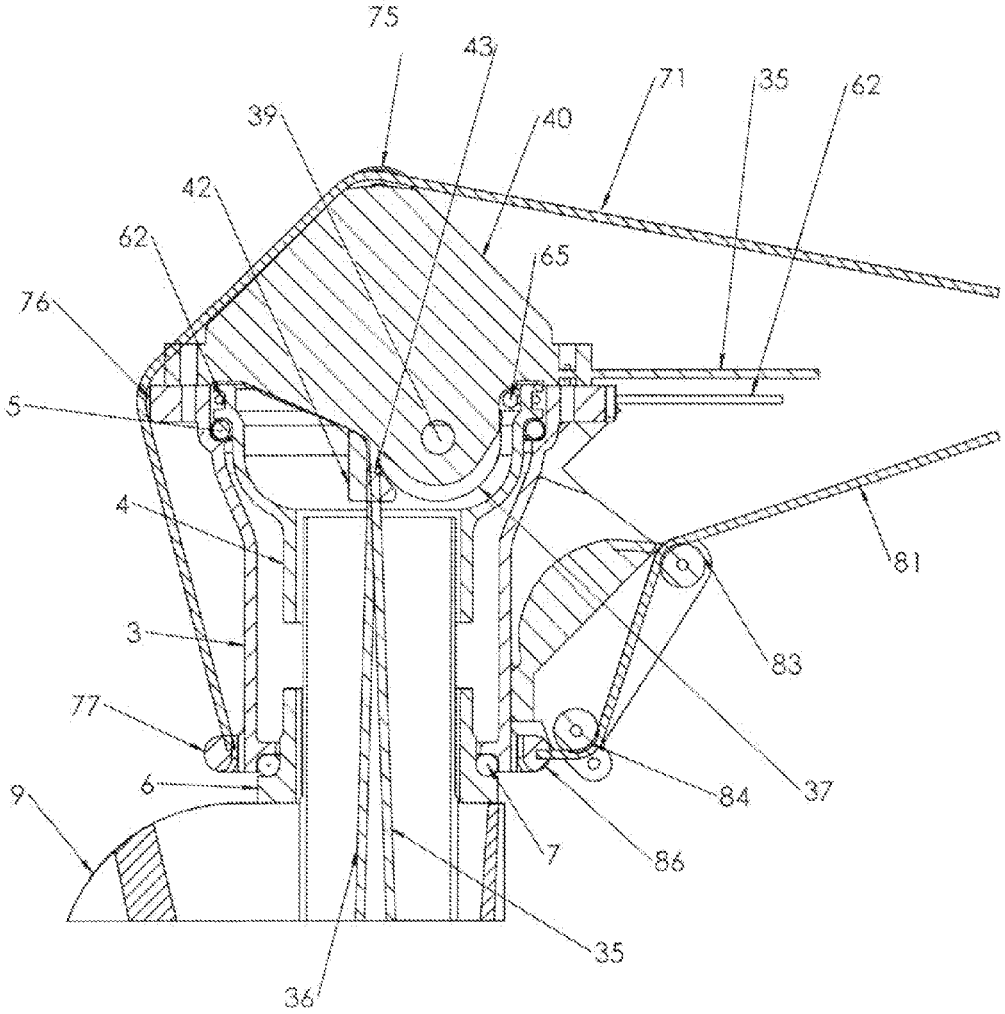
Figure 6 A-A (1 : 1.7)

B-B (1 : 2)

C-C (1 : 1.5)

SECTION F-F
SCALE 1 : 2

REMOTE DRIVE

Applicants claim the benefit of U.S. Provisional Patent Application 61/207,715 , filed Feb. 12, 2009.

FIELD OF THE INVENTION

This invention relates to propulsion system for watercraft.

BACKGROUND OF THE INVENTION

Small boats commonly use some mechanism to convert energy of the human body into a propulsive force to move the boat. A simple device is a paddle or oar; however, more sophisticated designs use the larger muscles of the lower body and feet to propel the boat and leave the hands free.

U.S. Pat. Nos. 2,158,349 and 5,090,928 describe a device that is powered by cables moving back and forth which turns the propeller or fins at the bottom of the rudder to create a propulsive force at the bottom of the rudder, but the steering is limited to angles much less than plus/minus 180 degrees and it can only be retracted about 100 degrees.

There are many patents that have pedals and turn a propeller which provide forward and reverse;

U.S. Pat. Nos. 7,371,138, 6,905,379, 6,210,242, 6,165,030, 6,165,029, 5,643,020, 4,968,274, 4,676,755, 4,648,846.

There are a few that have a propeller on the rudder which can provide forward, reverse and be able to turn the rudder about plus or minus 45 degrees. They can not rotate 360 degrees and they can not be stored on the deck.

U.S. Pat. No. 4,891,024 describes a design that would have forward, reverse and could steer, but the angle to which it could steer would be limited by the articulation of the universal joint in the shaft. This design has the pedals going in a circular motion which requires the feet to go much higher in their path. And the circular path has the dead zones.

U.S. Pat. No. 5,580,288 describes a design that would have similar capabilities but would have the same limitations for the same reasons.

There are several patents which are remotely powered with cables or ropes that activate a fin or paddle at the bow or stern:

U.S. Pat. Nos. 5,584,732, 5,584,732, 4,960,396, 6,077,134, 5,021,015, 6,997,765

SUMMARY OF INVENTION

A remotely driven watercraft having a bow and a stern, a deck, a rudder at the stern and a cockpit intermediate the bow and the stern comprising means carried by the watercraft comprising a source of propulsive power, said rudder being freely rotatable in any direction and carried about a vertical axis and having in proximity to its lower extremity a propeller for propelling the watercraft and means connecting said source of propulsive power with the bottom of said rudder to drive said propeller.

A remotely driven watercraft having a bow and a stern, a deck, a rudder at the stern and a cockpit intermediate the bow and the stern comprising means carried by the watercraft comprising a source of propulsive power, said rudder being freely rotatable in any direction and carried about a vertical axis and having in proximity to its lower extremity pairs of oppositely oscillating flexible fins for propelling the watercraft and means connecting said source of propulsive power with the bottom of said rudder to drive said pairs of oppositely oscillating flexible fins.

A remotely driven watercraft having a bow and a stern, a deck, a rudder at the stern and a cockpit intermediate the bow and the stern comprising means carried by the watercraft comprising a source of propulsive power, said rudder being freely rotatable in any direction and carried about a vertical axis and having in proximity to its lower extremity an electric motor and electrical means connecting said source of propulsive power with the bottom of said rudder to operate said electric motor and drive a propeller or fins.

A remotely driven watercraft having a bow and a stern, a deck, a rudder at the stern and a cockpit intermediate the bow and the stern comprising means carried by the watercraft comprising a source of propulsive power comprising a pair of pedals for receiving human input force, a seating area in said cockpit aft of said pedals for carrying a human operator, said rudder being freely rotatable in any direction and carried about a vertical axis and having in proximity to its lower extremity a propeller for propelling the watercraft and means connecting said pedals with said bottom of said rudder for driving said propeller comprising tension means running rearwardly from said pedals to said stern and downwardly to power said propeller.

A remotely driven watercraft having a bow and a stern, a deck, a rudder at the stern and a cockpit intermediate the bow and the stern comprising means carried by the watercraft comprising a source of propulsive power, including a pair of pedals for receiving human input force, a seating area in said cockpit aft of said pedals for carrying a human operator, said rudder being freely rotatable in any direction about a vertical axis and having in proximity to its lower extremity a propeller for propelling the watercraft, and means connecting said source of propulsive power with said bottom of said rudder for driving said propeller, said source of propulsive power comprising hydraulic means operatively connected to said pedals to generate fluid pressure, and means conveying said fluid pressure running rearwardly from said hydraulic means to said stern and downwardly to hydraulically power said propeller.

In one embodiment of this invention the propulsion device resembles the lower unit of an outboard motor. It looks like a rudder with a propeller near the bottom. At the top there are two pulleys that turn the two power cables 90 degrees down into the rudder.

In this embodiment the power cables terminate in a pair of spools which are on clutch bearings which are on the propeller shaft. Before the cables terminate they wrap around the spools several times. One end of a third cable is terminated in the opposite end of the spool. This third cable makes several wraps around the spool and then proceeds deeper down into the rudder where it passes around a pulley which it turns it about 180 degrees. The cable then goes back up and makes several wraps around the other spool and terminates on the spool.

When one of the power cables is pulled, the spool turns and the cable unwinds from one of the spools. The third cable winds onto the spool as it moves. This movement causes the second spool to turn in the opposite direction and the second power cable is wrapped around the second spool. Since the power cables are attached to the pedals the pedals will be moving back and forth.

When the power cables move back and forth the spools spin back and forth in opposite directions. Since the spools are mounted on the propeller shaft on clutch bearings (the spools are allowed to spin freely in one direction on the shaft) the shaft will turn in just one direction and turn the propeller which creates thrust.

In a second embodiment the two power cables come down the rudder and each cable is split into two. The bottom of the rudder has one shaft free to rotate inside a hollow shaft which is free to rotate. The front of each shaft is fitted with a drum. The first power cable splits and one cable winds about 270 degrees around one of the drums and terminates to the drum. The other cable winds about 270 degrees around the other drum in the opposite direction and terminates to the drum. The second power cable splits and the two ends terminate on the drums in the same manner, but in the opposite direction. The final result is that when one cable is pulled the two drums turn in opposite direction. The second power cable is taken up or drawn around the two drums. Again as the two pedals move back and forth the two drums spin back and forth in opposite directions and thus the two concentric shafts spin in opposite directions.

On the back of each shaft is mounted a pair of steel rods. On these steel rods is mounted two pairs of flexible fins. The internal shaft extends further aft and the aft pair of fins is mounted on the internal shaft. These flexible fins are free to rotate on the steel rod and fixed to the shaft in such a way that when the shaft turns and the fin is pushed through the water the fins twist and flex in such a way that it assumes the shape of a propeller blade. The flexible fins are able produce forward thrust regardless of which direction the shafts are turning.

Since the power cables are relatively thin and flexible they can tolerate a certain amount of twisting as they travel down the rudder. This attribute will allow the cables to transmit power as the rudder is turned up to 270 degrees to the left and right. If the rudder is turned 90 degrees the boat will turn within its own length. If the rudder is turned 180 degrees it will go in reverse. The ability to turn the rudder more than 180 degrees will allow the pilot to steer left or right in reverse.

An upper and lower set of ball bearings is provided to allow the rudder to turn about a vertical axis to steer the boat. The upper bearing must be large to create space for the two pulleys that turn the power cables 90 degrees into the rudder.

It is important that tension from the power cables or thrust from the propeller or fins do not cause a torque on the rudder which will steer the boat. Thus the power cables pass very near the center of rotation for the rudder.

Just above the upper bearing is the quadrant or a groove for the steering lines. There are two lines—one turns the rudder to the right and the other turns the rudder to the left. From the centered position each line can turn the rudder 270 degrees right or left.

The rudder is also able to rotate back and out of the water. It can continue for 270 degrees until it lays on the deck of the boat. It can also turn 90 degrees so that it lays flat on the deck. Special accommodations have been made for the power lines and the steering lines. The steering lines pass right through the center of rotation for this movement so the tension in the steering lines does not change as the rudder is rotating up. The power lines will come off of the 90 degree turning blocks and bend around to allow the rudder to rotate through 270 degrees. The propulsion device will work—you can pedal and create thrust while the rudder is rotating up until it reaches 90 degrees and the power cable will begin to rub. This will allow the drive to work in less water depth.

There are two lines to control the position of the rudder. One line pulls the rudder down into the normal operating position and locks it there. This line is under considerable pressure in reverse as the drive tries to kick itself up. A second line will raise the rudder and stow it on the deck.

The forces of the power cables pass just above the center of rotation for this movement and they cause some torque to raise the rudder, but this torque is easily dealt with.

OBJECTS AND ADVANTAGES

The main objective of the design is to make a foot operated propulsion device for small watercraft that can be operated remotely. A foot powered craft is better because people tend to have a lot more power in their lower body and it leaves the hand free for other tasks.

Power must be transmitted to the drive through a pair of cables or ropes moving in a back and forth motion. This back and forth motion of the cables lends itself well to the back and forth motion of the pedals which is desirable. Pedals that go back and forth can be mounted much lower and are simpler. The resistance you feel on the pedals is smoother. A circular motion can still be used.

Also the pilot of the boat should be able to direct the direction of the thrust of the drive in any direction to steer and go in reverse. This will greatly improve the maneuverability of the boat. The pilot should be able to steer the boat with a small tiller. Combining the rudder and the propulsion device into one unit will simplify the boat.

Also the pilot should be able to deploy and retract the drive from the seated position. The drive should be able to be stowed flat on the deck of the boat and then the pilot should be able to lock it into the normal operating position. If the drive hits an obstacle in the water, the drive should be released automatically to avoid damage.

It is desirable to use a folding propeller because:

1) The propeller does not produce drag while gliding or while sailing.
2) The propeller is less likely to be damaged if it strikes something.
3) The propeller maybe able to shed sea weed when it folds.

Folding props are common in sail boats and are relatively simple unless they are required to work in reverse because the blades will just fold. With the remote drive the propeller is always producing force in the same direction and the drive rotates 180 degrees to go into reverse so the folding propeller will be relatively simple.

Relative to a drive that spins the prop in reverse to produce reverse thrust the remote drive has an advantage because the prop is always producing thrust in one direction. The thrust of a prop turning in the reverse direction is compromised because the propeller is designed to be more efficient in the forward direction.

Typically the balance of a rudder is completely wrong for a boat going in reverse. Typically a rudder of a boat or plane will have between 85% and 60% of the rudder area behind the pivot line. So if the boat goes in reverse there is too much area ahead of the pivot line and the rudder will be unstable. The pilot will have to actively work to prevent the rudder from turning all the way to the stop. Since the rudder of the remote drive turns 180 degrees to go in reverse the balance of the rudder will always stay the same. This is an advantage for a fisherman who prefers to troll in reverse and watch his line in his wake.

A further benefit of the invention is the ability to push the stern of the boat in any direction—forward, reverse or any angle in between which enable the boat to turn at any turning radius. A further benefit is the ability to retract the device and store it flat on the deck of the watercraft.

THE DRAWINGS

FIG. 6 is a sectional view of the top of the remote drive from FIG. 4.

FIGS. 16, 17, 18, and 19 show other alternative embodiments.

Figure 20:
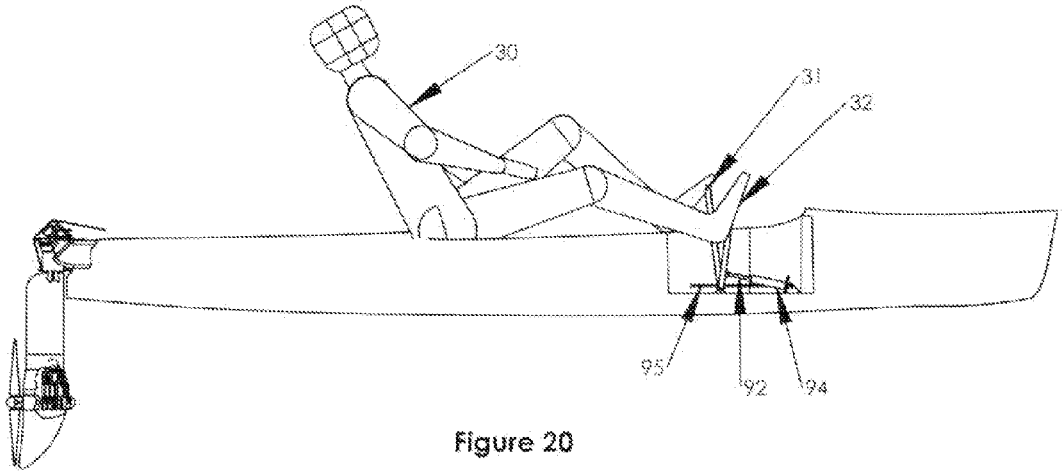
Figure 21:
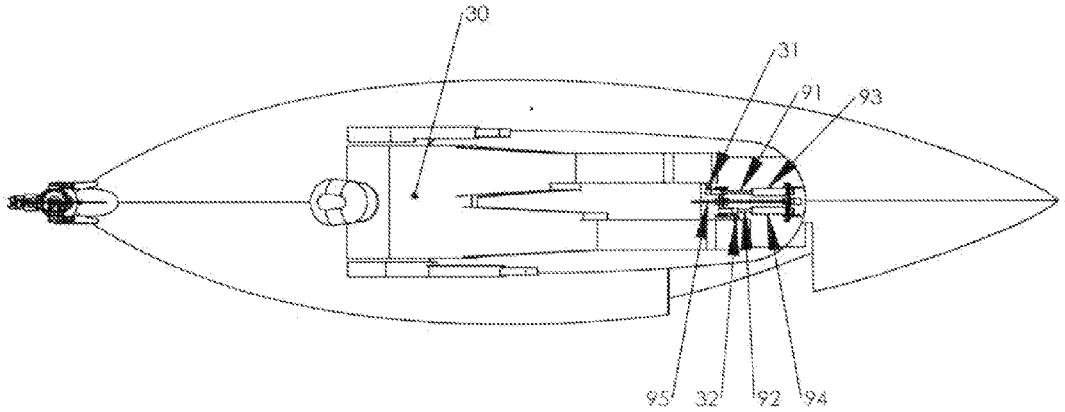

FIGS. 20 and 21 show an alternative embodiment where human input power is transferred to the rudder via hydraulic fluid.

Figure 22:
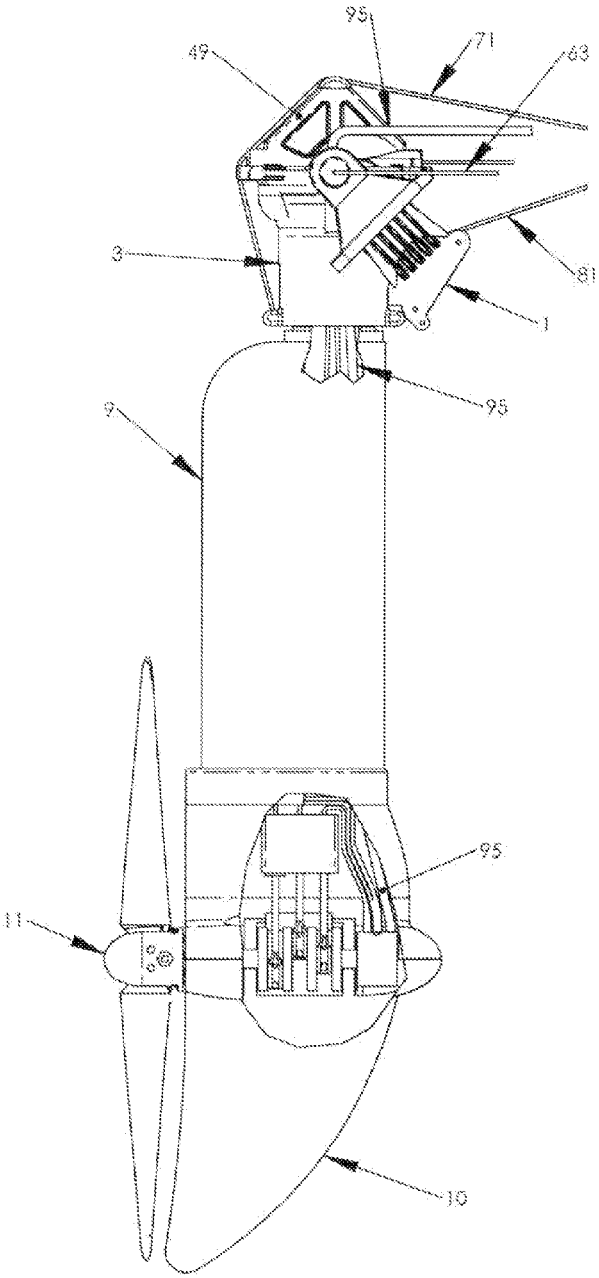
Figure 23:
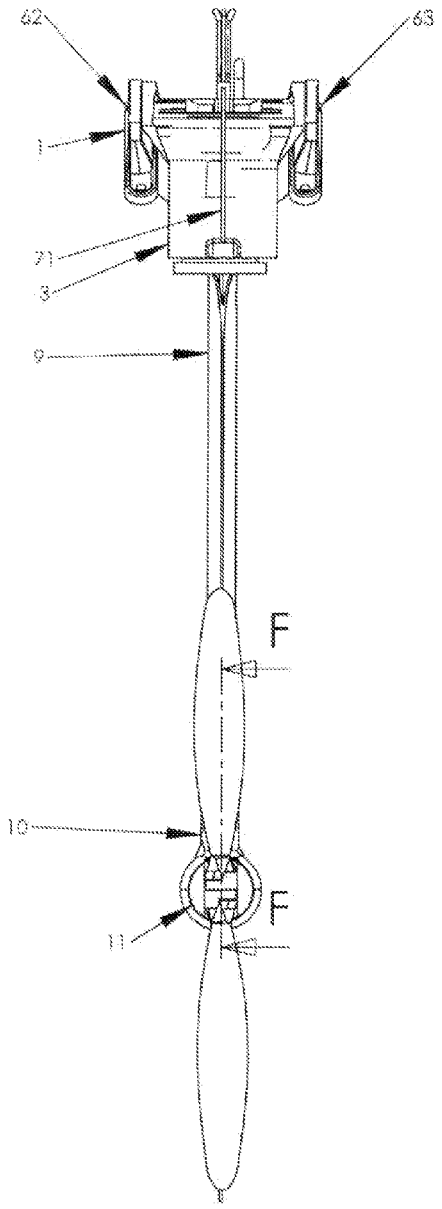

FIGS. 22 and 23 show an alternative embodiment of the remote drive where power is transfer with a hydraulic fluid.

Figure 24A:
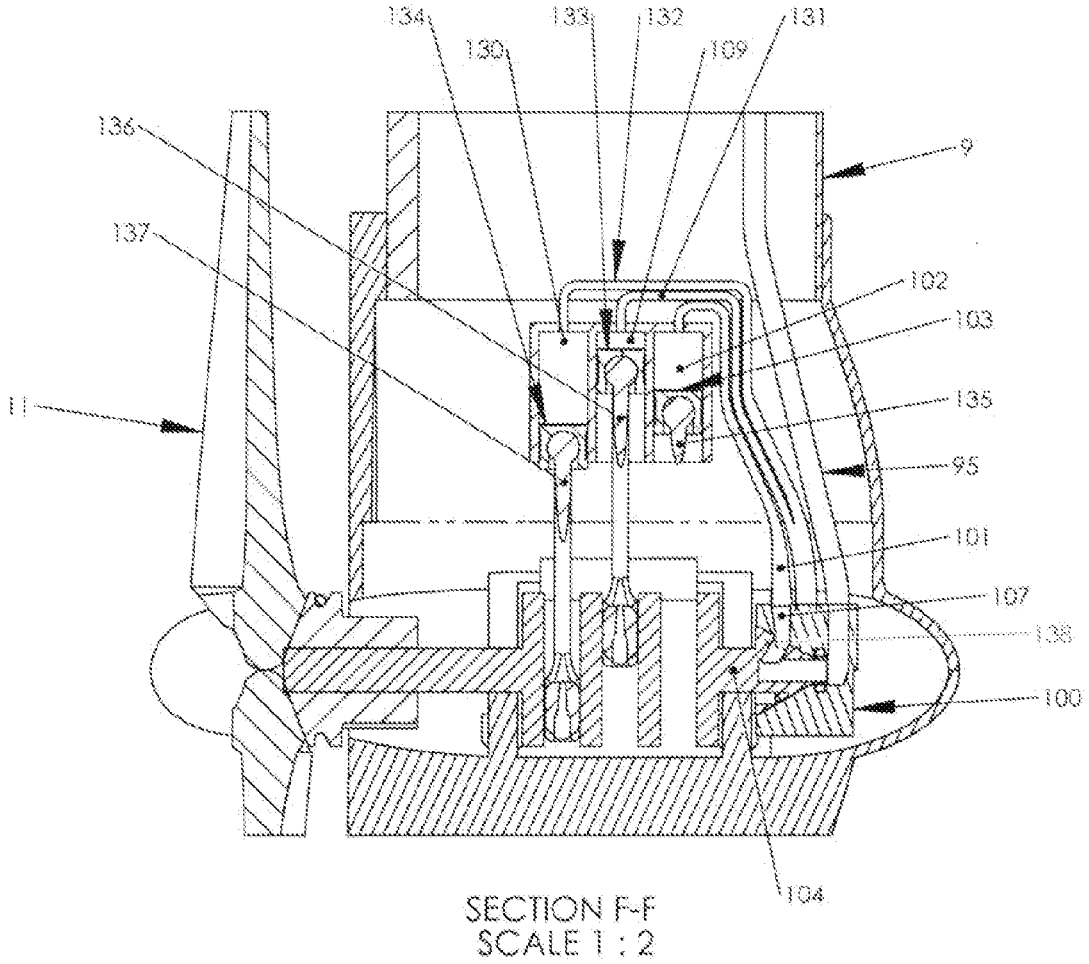

FIG. 24*a* shows details of a hydraulic motor where the forward piston is going down—the power stroke.

Figure 24B:
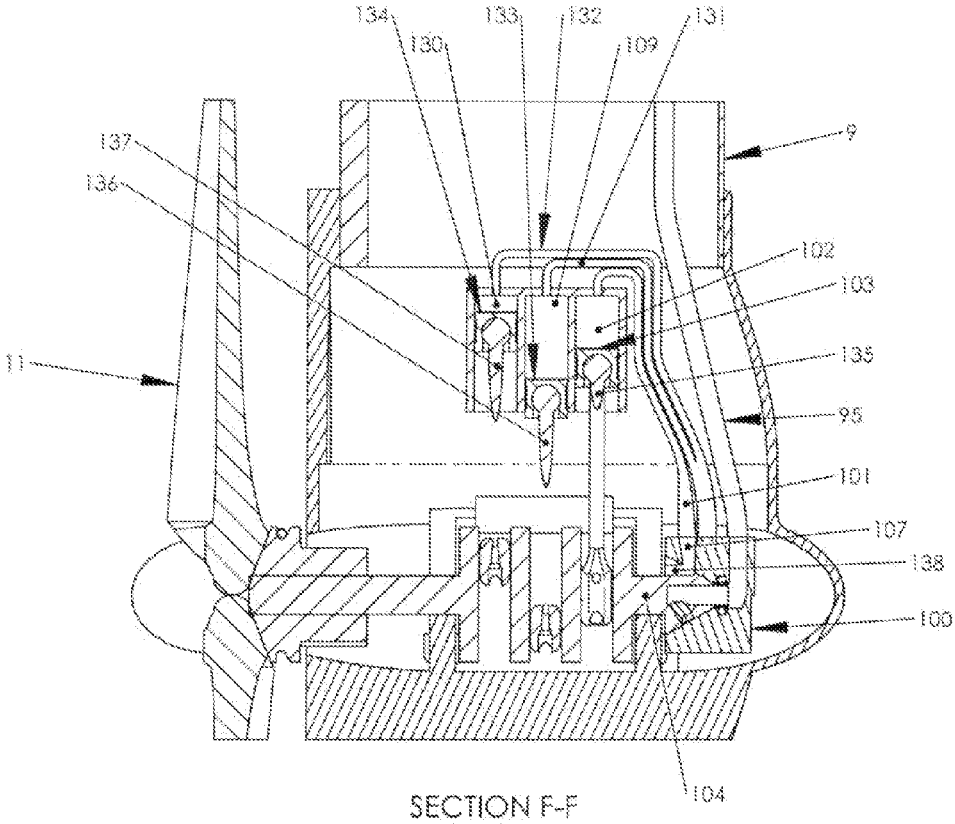

FIG. 24*b* shows details of a hydraulic motor where the forward piston is going up—the exhaust stroke.

Figure 25:
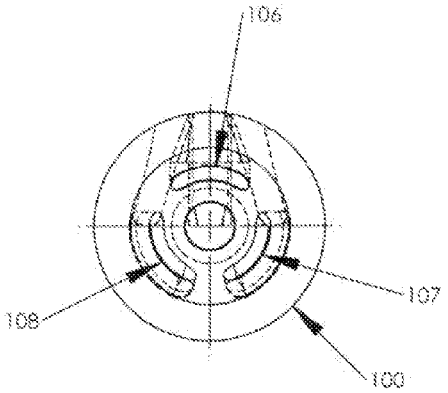
Figure 26:
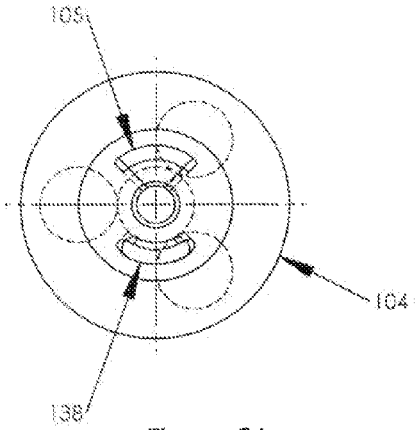

FIGS. 25 and 26 show end views of the rotary valve and crankshaft.

Figure 27:
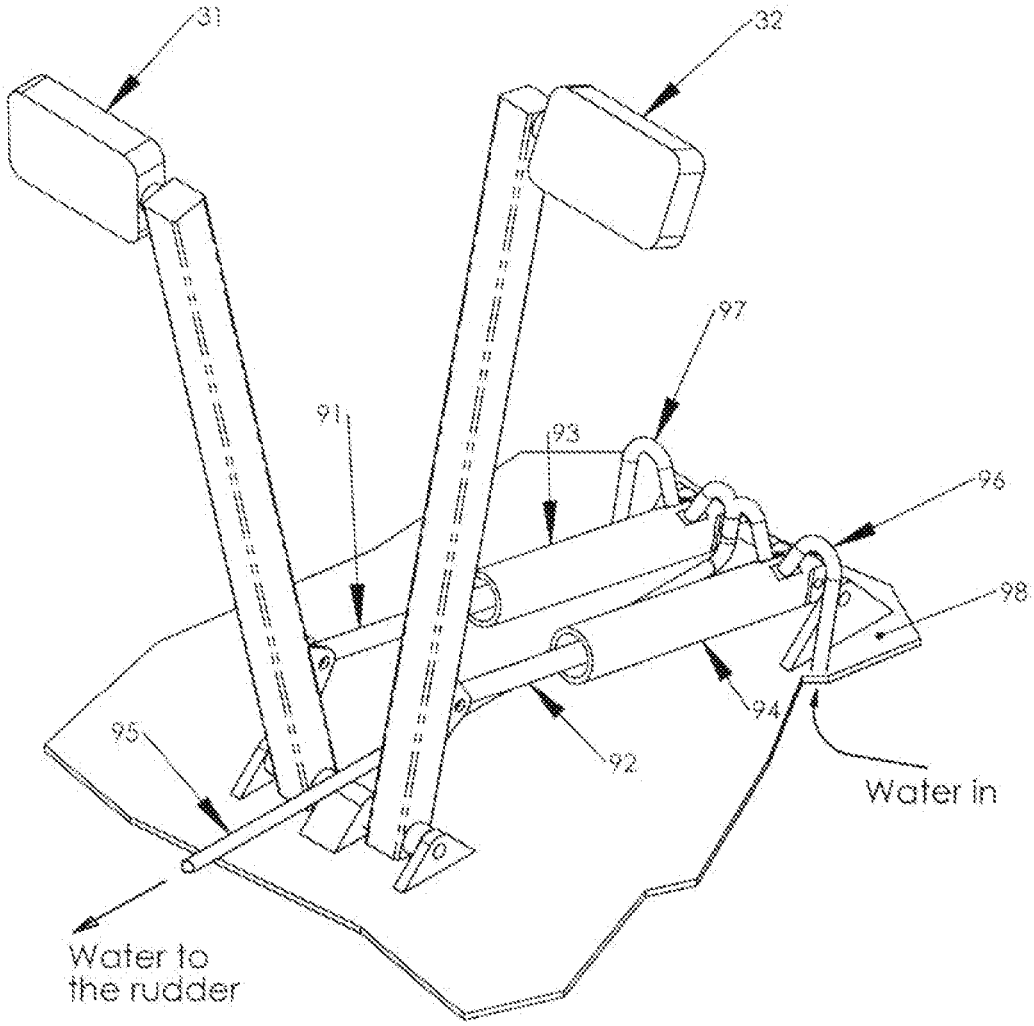

FIG. 27 shows details of pedals and hydraulic pumps.

Figure 28:
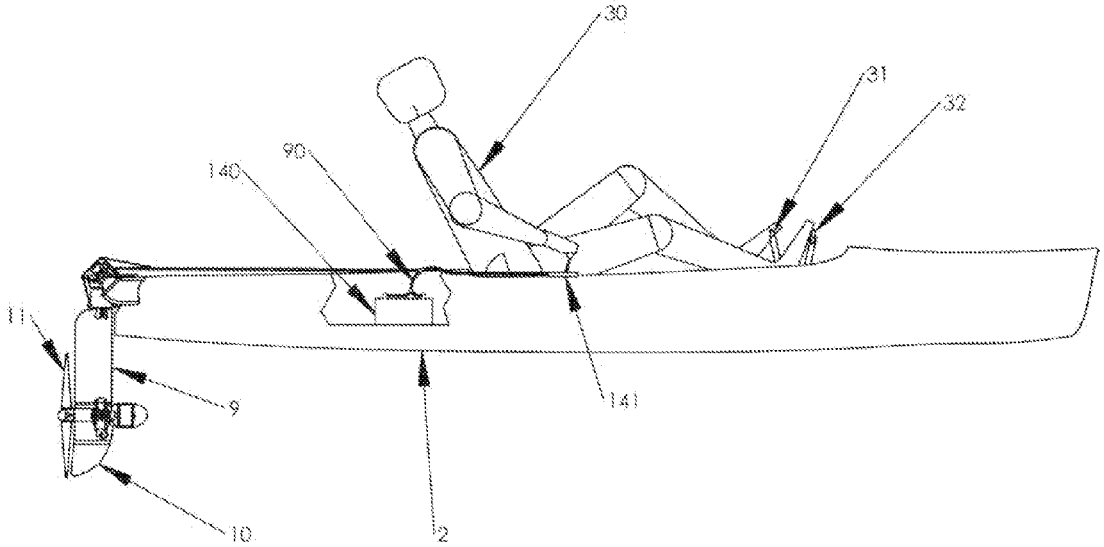

FIG. 28 shows the remote drive with an electric motor option on a kayak.

Figure 29:
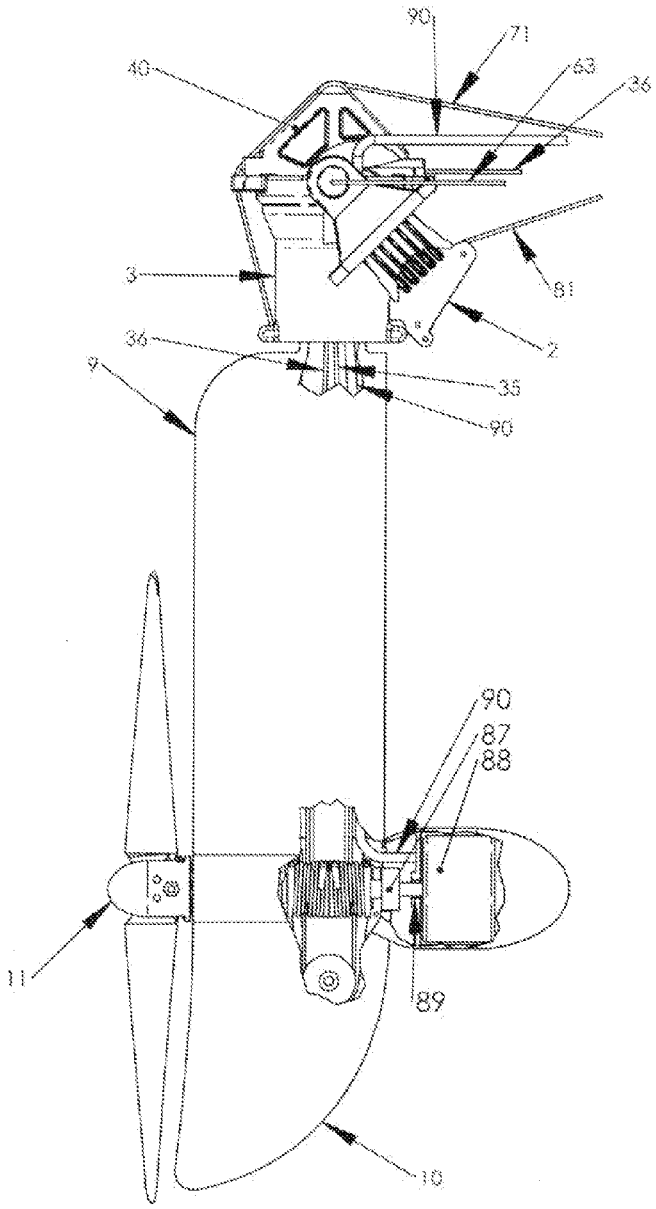
Figure 30:
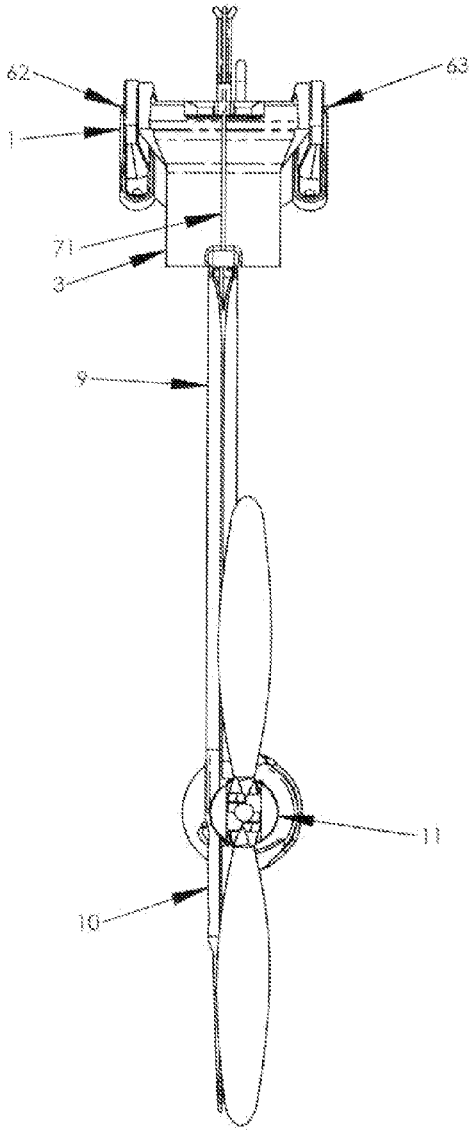

FIGS. 29 and 30 show an alternative embodiment of the remote drive with electric motor assist.

DESCRIPTION OF THE PREFERRED EMBODIMENTS

Considering the drawings FIGS. 1 to 30 in more detail, the rudder bracket 1 is fastened to hull 2 with four #10 screws. The rudder mount 3 snaps into the rudder bracket 1 and can pivot 270 degrees. A set of ball bearings 5 is captured between the rudder quadrant 4 and the rudder mount 3 and the rudder quadrant 4 can rotate inside the rudder mount 3. A second set of ball bearings 7 is captured between the lower bearing 6 and the rudder mount 3 and the lower bearing 6 is free to rotate. Lower bearing 6 is fixed to the rudder quadrant 4 with 3 screws. The strut 9 slides into the lower bearing 6 and the rudder quadrant 4.

The rudder 10 slides into the bottom of the strut 9 and is secured. The propeller assembly 11 slides into the rudder 10 and the rear bearing 17 is secured to the rudder 10 with a #10 screw. The pawl 12 slides into the recess in the rudder 10 is secured with a spring. The pawl 12 engages the ratchet in the propeller hub 14 and will prevent the propeller from rotating in a counter clockwise direction when looking at the drive from behind.

The propeller shaft 15 is secured in the propeller 11 with a #10 screw. The rear bearing 17 and the spacer 18 are placed onto the shaft. The rear bearing 17 and the spacer 18 are placed onto the shaft. The spacer 18 is secured to the shaft with a ¼-20 set screw. A clutch bearing 19 is pressed into the front spool 21 and the rear spool 20. A plastic bushing 23 is placed inside the front spool 21 and the rear spool 20 on each side of the clutch bearing 19. The plastic bushing 23 keeps the spool centered on the propeller shaft 15 to minimize friction. An O ring 22 is placed inside each end of front spool 21 and rear spool 20. The O rings seal oil inside the spool for the clutch bearing and keep water and dirt out. The direction of the spiral cut in the front spool 21 is opposite from the rear spool 20.

The inside of the clutch bearing 19 has 10 hardened steel rods (0.092"×0.305") 25. The inside surface of the clutch bearing 19 has a ramp 27 for each steel rod 25. A plastic leaf spring 26 pushes the steel rod 25 onto the ramp 27. When the clutch bearing 19 is rotated clockwise when looking from the rear of the boat the steel rod 25 rides up the ramp 27 and the steel rod 25 is pushed toward the propeller shaft 15 and the clutch bearing 19 is essentially fixed to the propeller shaft 15. When the propeller shaft 15 is rotated clockwise with respect to the clutch bearing 19 while looking from the rear of the boat the steel rod 25 rides down the ramp 27 away from the propeller shaft 15. The propeller shaft is free to rotate in a clockwise direction while looking at the boat from the rear.

Power from the rider 30 is transmitted to the pedals 31 and 32 by moving the pedals back and forth with a stepping motion of the rider's 30 feet. Power from the pedals 31 and 32 is transmitted back to the rudder via a pair of power cables 33 and 34. A loop 52 is formed in the front end of twin pairs of power cables 35 and 36 with a swage 53. Power cables 33 and 34 are connected to the loop 52 of the twin pairs of power cable 35 and 36. The twin pairs of power cables 35 and 36 are made up of two smaller cables (nylon coated 1/16" 7×19 stainless steel) that are better suited for rounding the small diameter of the pulleys 37 and 38 and the front and rear spools 21 and 20.

The twin pairs of power cables 35 and 36 come back and are turned by pulleys 37 and 38 and go down through the strut 9 and into the rudder 10. Pulleys 37 and 38 are supported by ⅜" bolt 39. The ⅜" bolt 39 is supported by pulley support 40, 41 and 42. Pulley supports 40, 41 and 42 are fastened to the rudder mount 3 with 6 #10 screws. Cable capture device 43 is fastened to pulley supports 41 and 42 with 2 #6 screws. The cable capture device prevents the two cables from twisting as they go onto the pulleys 37 and 38.

The twin pairs of power cables 35 and 36 come into the rudder 10 and begin to wrap around the front and rear spools 21 and 20 and are terminated in the front and rear spools 21 and 20 with a swage 46. Tension in the twin pairs of power cables 35 and 36 will cause the front and rear spools 21 and 20 to rotate in a clockwise direction while viewing the boat from the rear. The idler pulley cable 47 terminates in the front and rear spools 21 and 20 with a swage 51. The idler pulley cable 47 passes around the idler pulley 48 which is supported by idler pulley axle 49. Idler pulley door 50 covers the pulley and supports the idler pulley axle 49.

The steering handle 60 is in close proximity to the left hand of the rider 30 who is located in the cockpit 8. The steering handle 60 is connected to the steering quadrant 61. The steering lines 62 and 63 are wrapped around the steering quadrant 61 and go aft to the rudder 10. The steering lines go through the rudder bracket 1 and rudder mount 3 and turn aft and wrap about 270 degrees around the rudder quadrant 4 and terminate with 2 knots 64 and 65 on the inside of the rudder quadrant. The steering handle 60 can be rotated to the right or the left up to 270 degrees which will cause equal amount of rotation of the rudder quadrant 4 in the opposite direction.

To retract the remote drive the rider 30 pulls on the up line control handle 70 which is attached to up control line 71. Pulleys 72, 73, and 74 direct the up control line 71 back to the remote drive. The up control line 71 passes over a line guide 75 on the top of the pulley support 40 and then passes over a line guide 76 on the rudder mount 3 and then it terminates with a knot in the rudder mount 3 at 77. Tension in the up control line 71 will cause the remote drive to rotate up about 270 degrees until it lays flat on the deck 78. The remote drive can be steered 90 degrees to the right or left so that it lays flat on the deck 78.

To deploy the remote drive the rider 30 pulls on the down line control handle 80 which is attached to down control line 81. Pulleys 82, 73, and 74 direct the down control line 81 aft to the remote drive. The down control line 81 passes over the sheaves 83 and 84 and then it terminates with a knot at 86.

Figure 1:
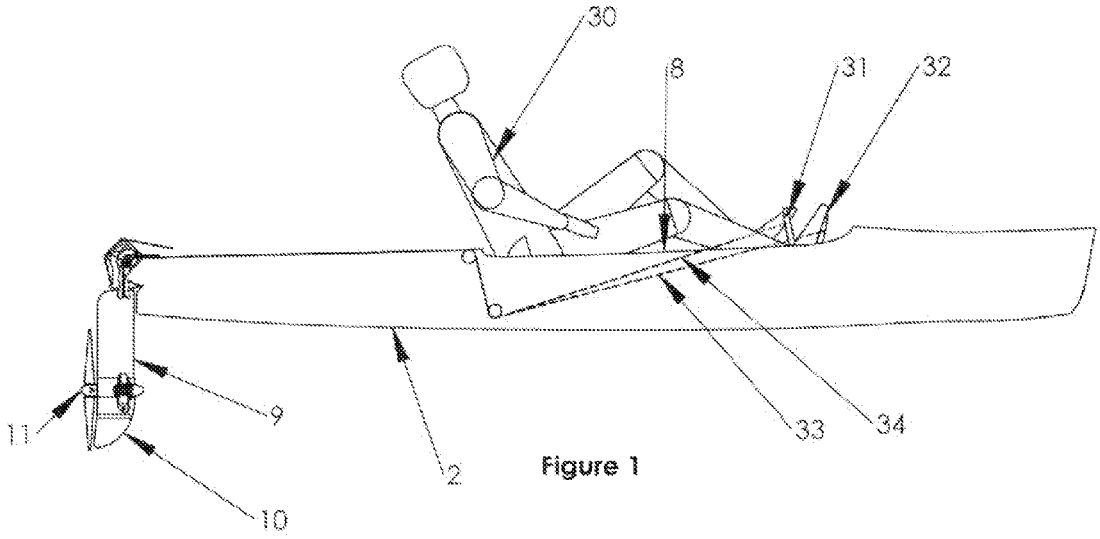
FIG. 1 is a side view of the remote drive in the down position on a kayak.
Figure 2:
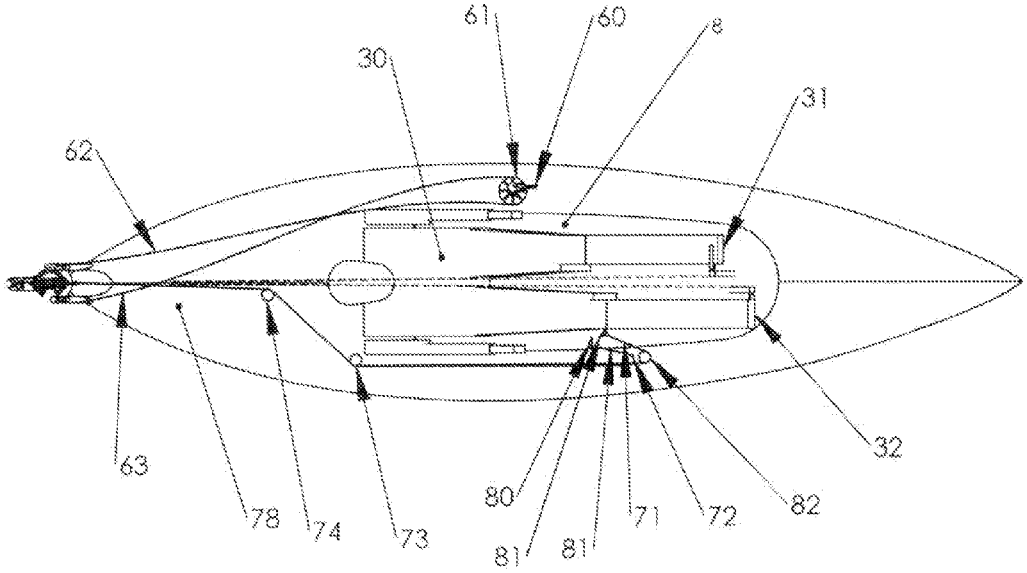
FIG. 2 is a top view of the remote drive in the down position on a kayak.
Figure 3:
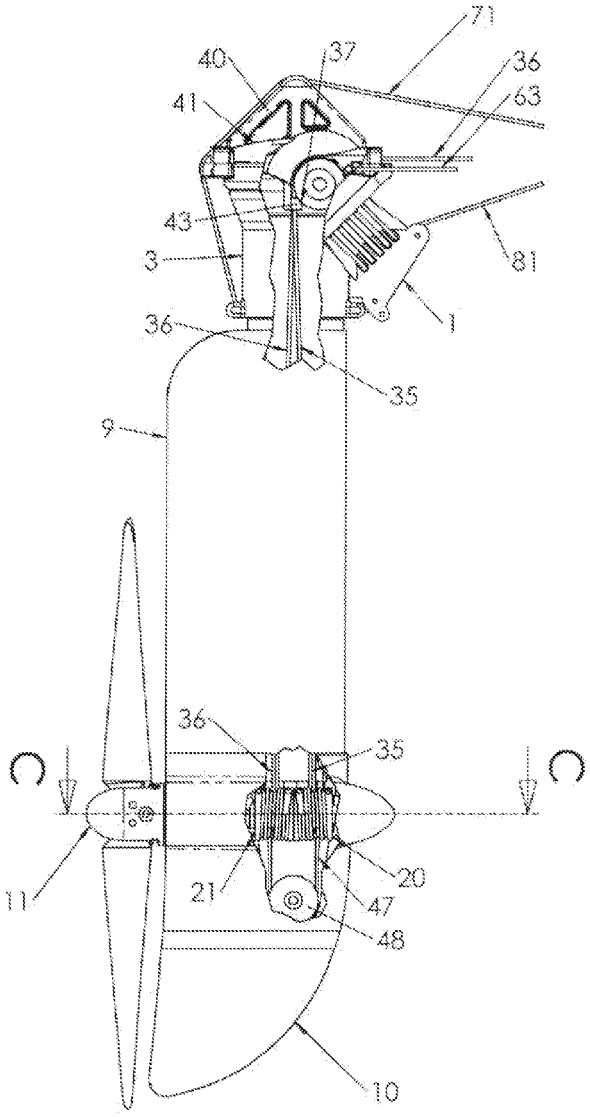
FIG. 3 is an expanded side view of the remote drive with cutaways to show the cables inside.
Figure 4:
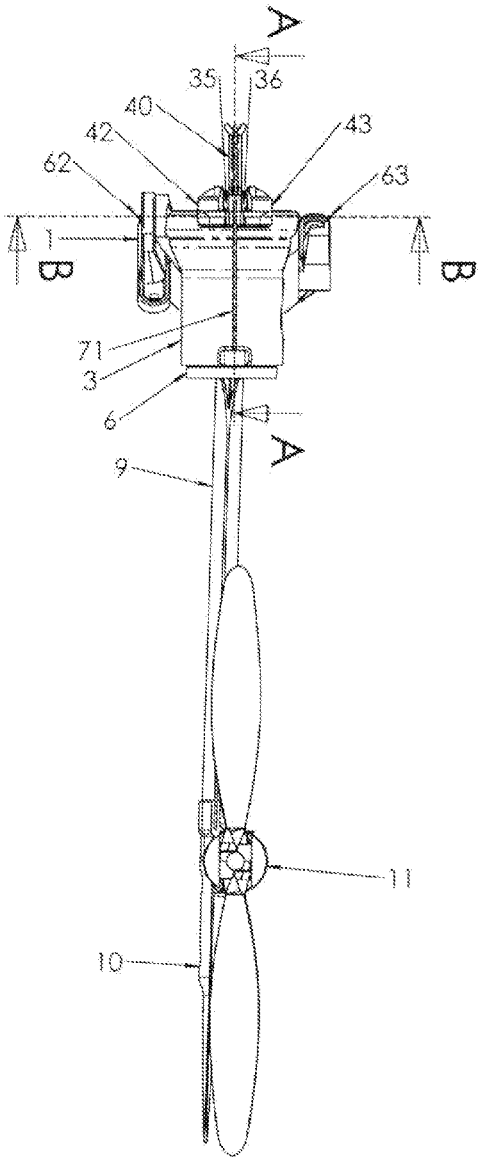
FIG. 4 is an expanded rear view of the remote drive.
Figure 5:
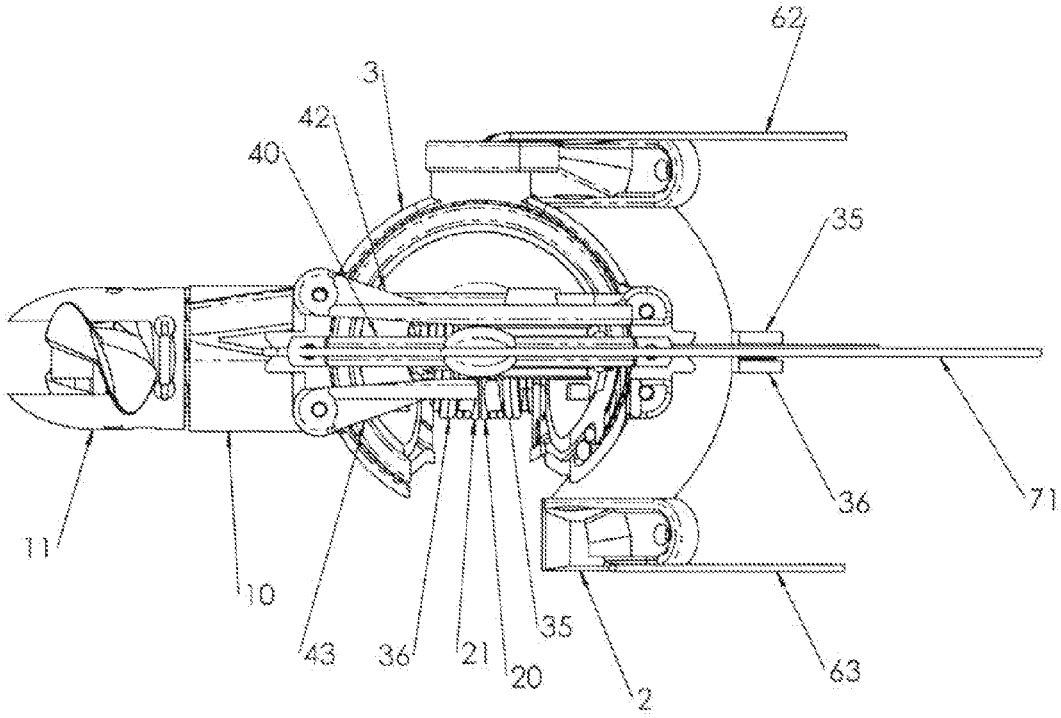
FIG. 5 is an expanded top view of the remote drive.
Figure 8:
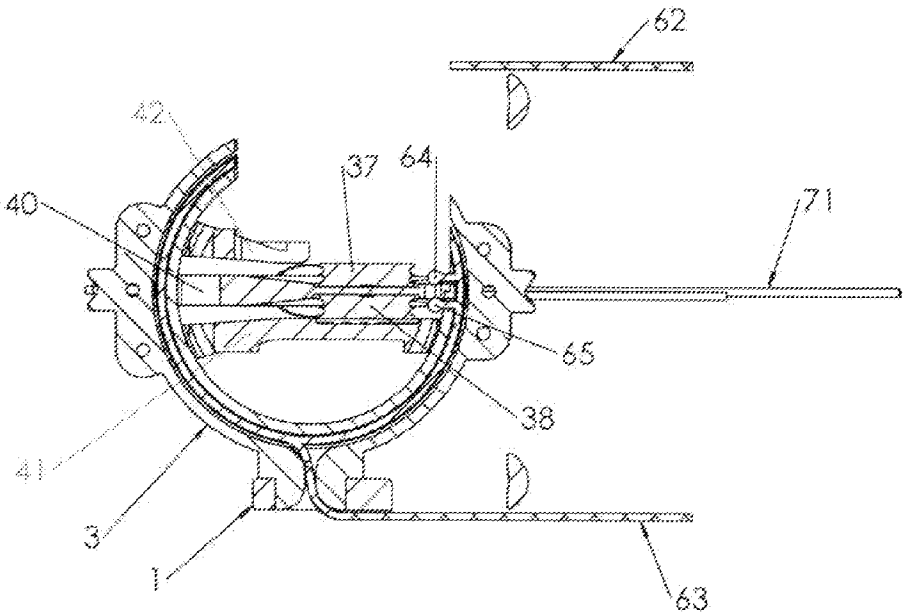
FIG. 8 is a sectional view of the top of the remote drive showing the steering line. Sectioned along line B B from FIG. 4.
Figure 7:
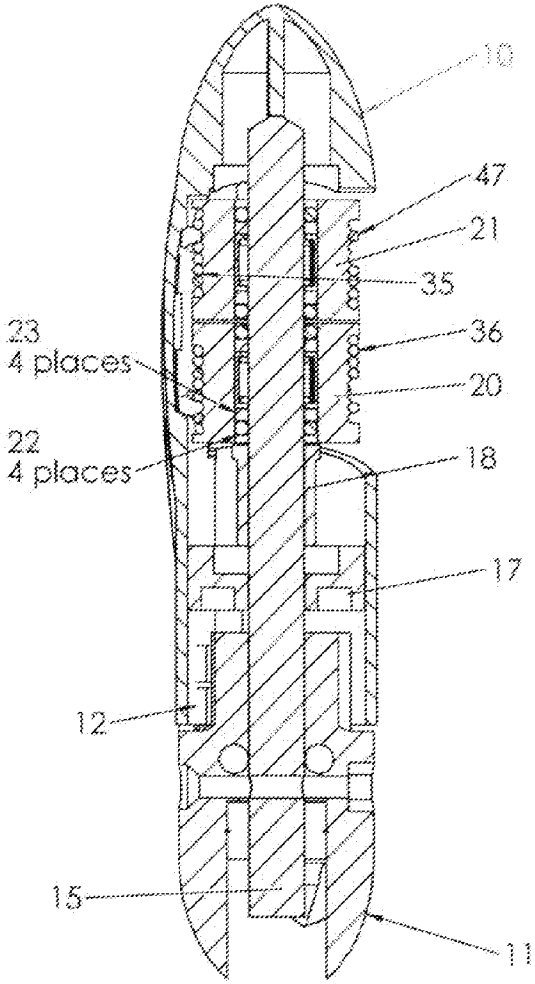
FIG. 7 is a sectional view of the bottom of the remote drive. Sectioned along line C C from FIG. 3.
Figure 9:
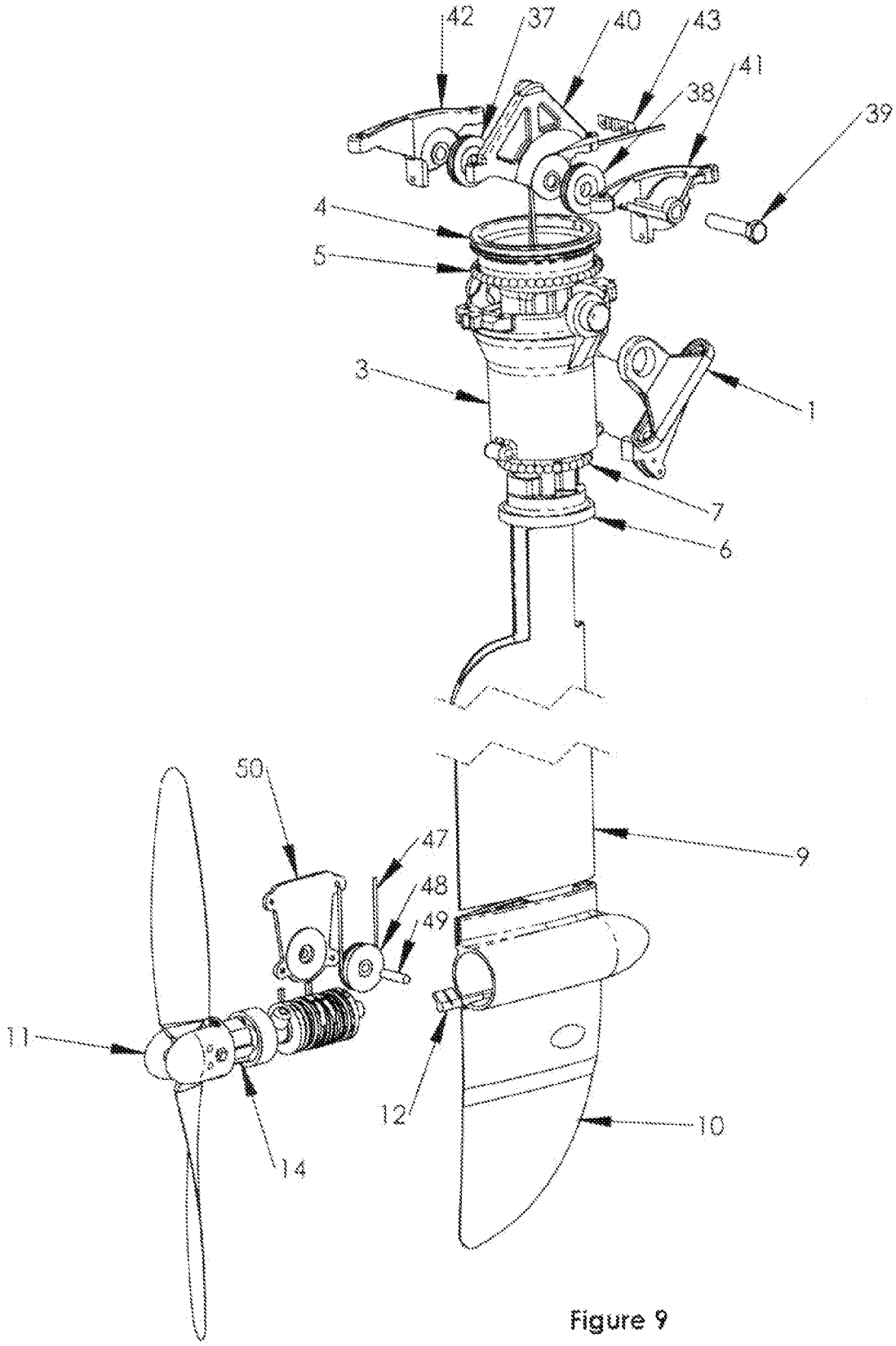
FIG. 9 is an exploded isometric view of the remote drive.
Figure 10:
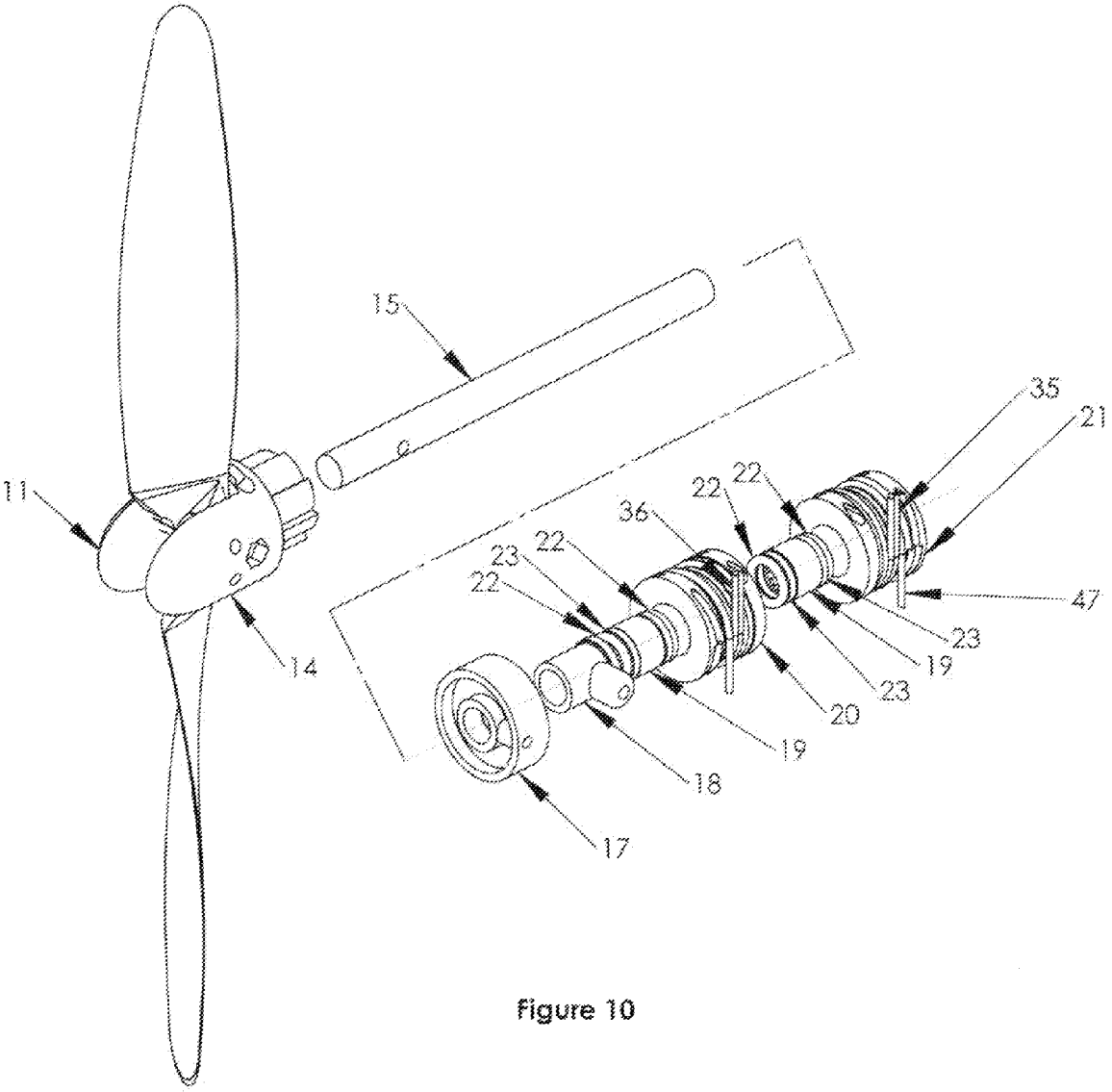
FIG. 10 is an exploded isometric view of the propeller assembly.
Figure 11:
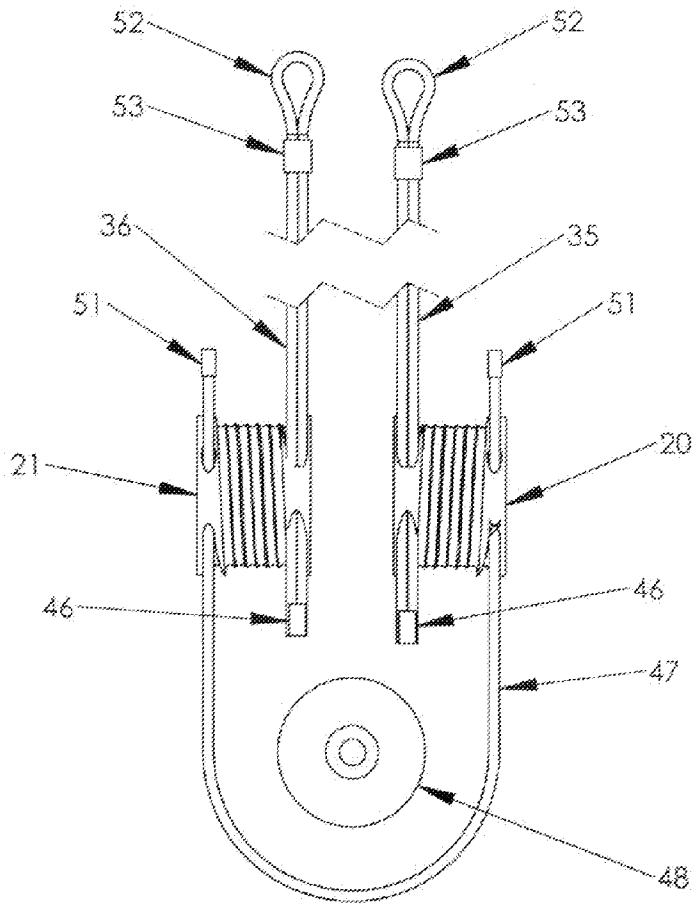
FIG. 11 is a detail view of the cable and spool assembly.
Figure 12:
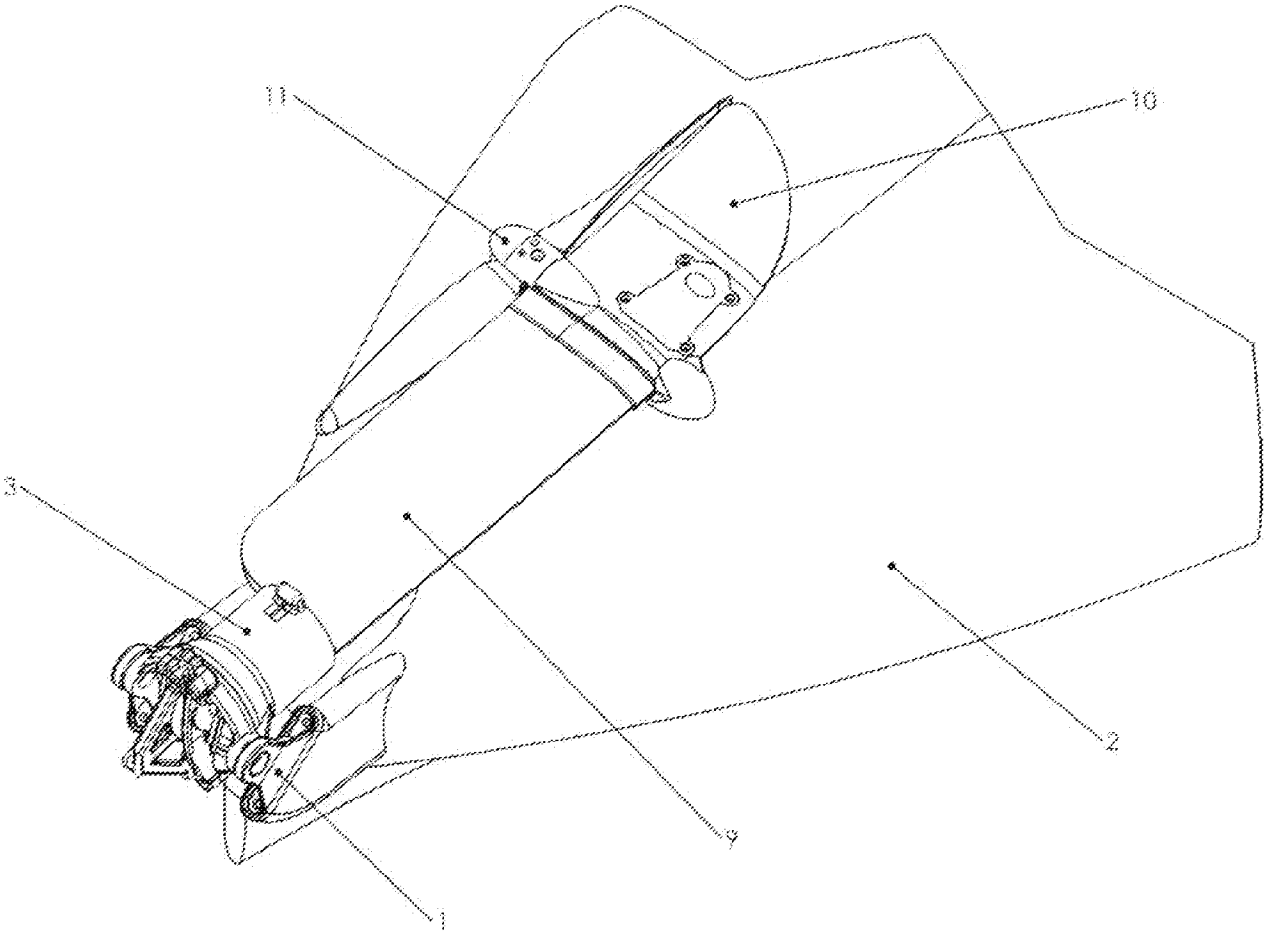
FIG. 12 shows the remote drive retracted and laying flat on the deck of a kayak.
Figure 13:
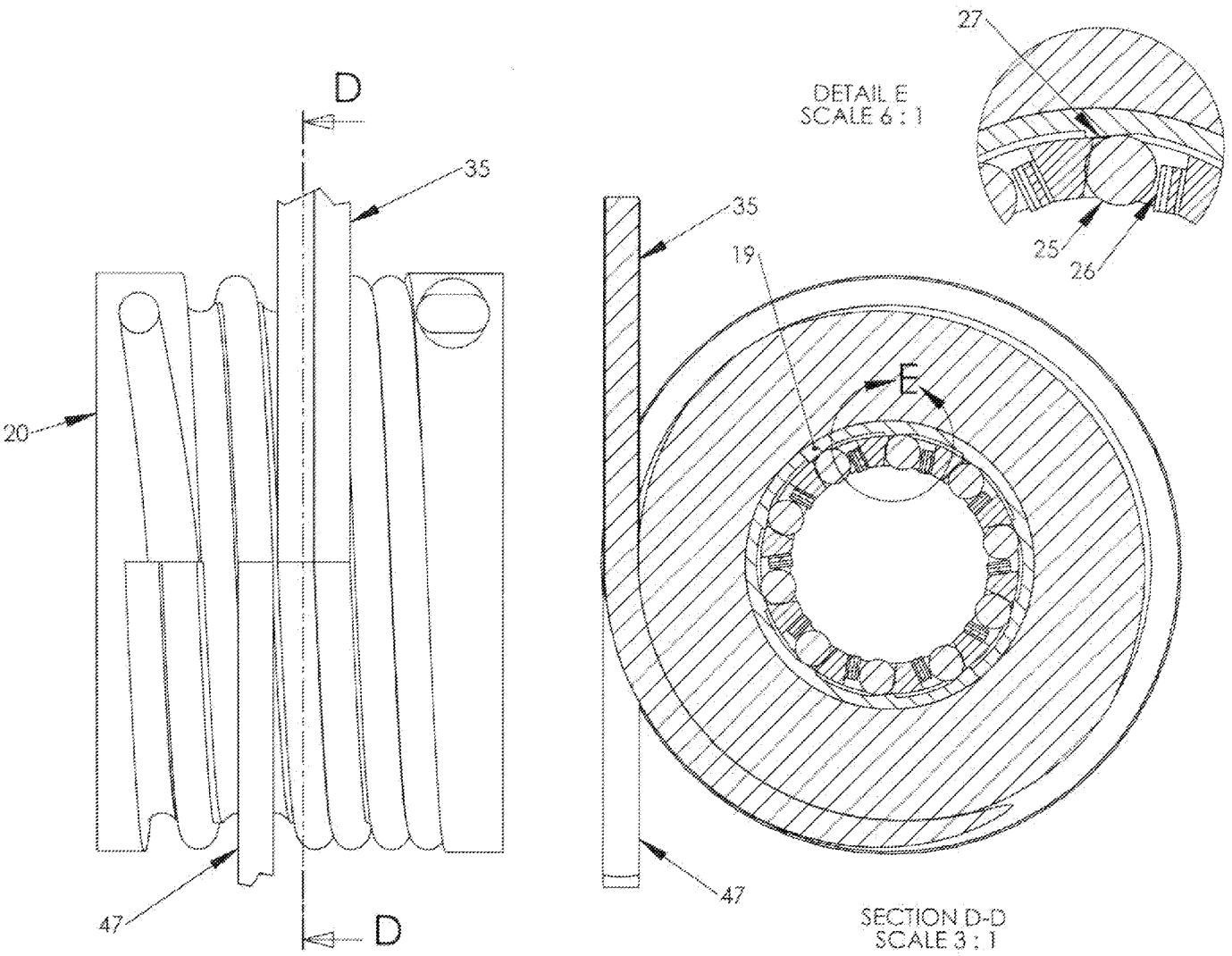
FIG. 13 shows a cross sectional view of the spool and clutch bearing assembly.
Figure 14:
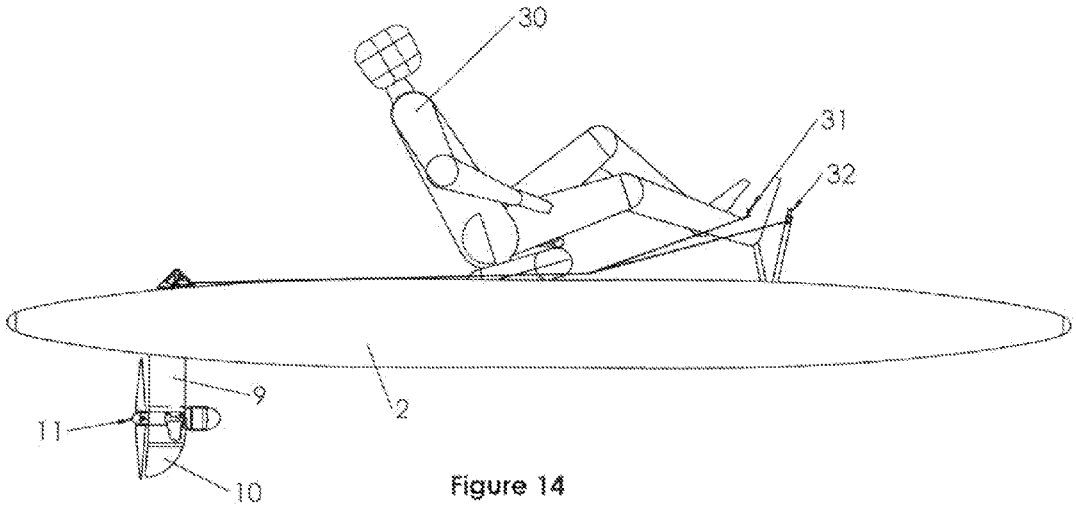
FIGS. 14 and 15 show an alternative embodiment with the remote drive on a catamaran.
Figure 15:
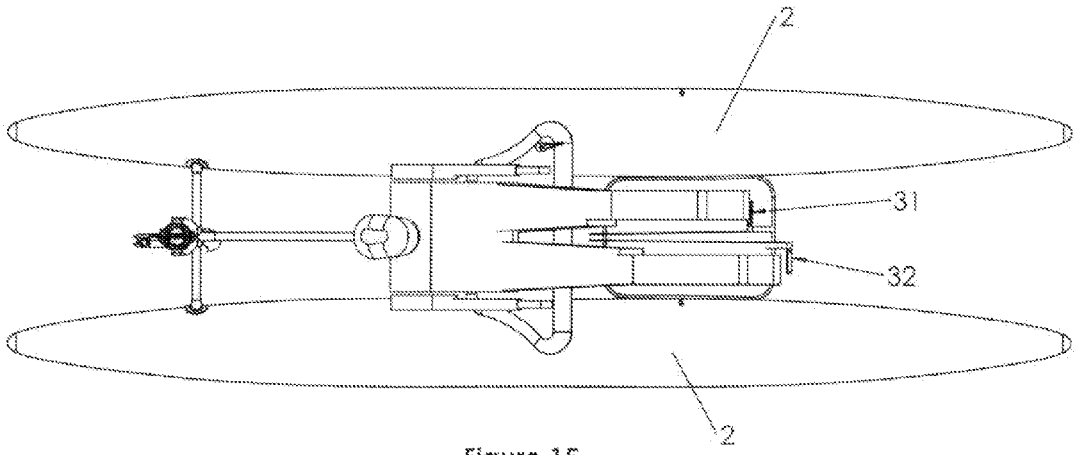
Figure 16:
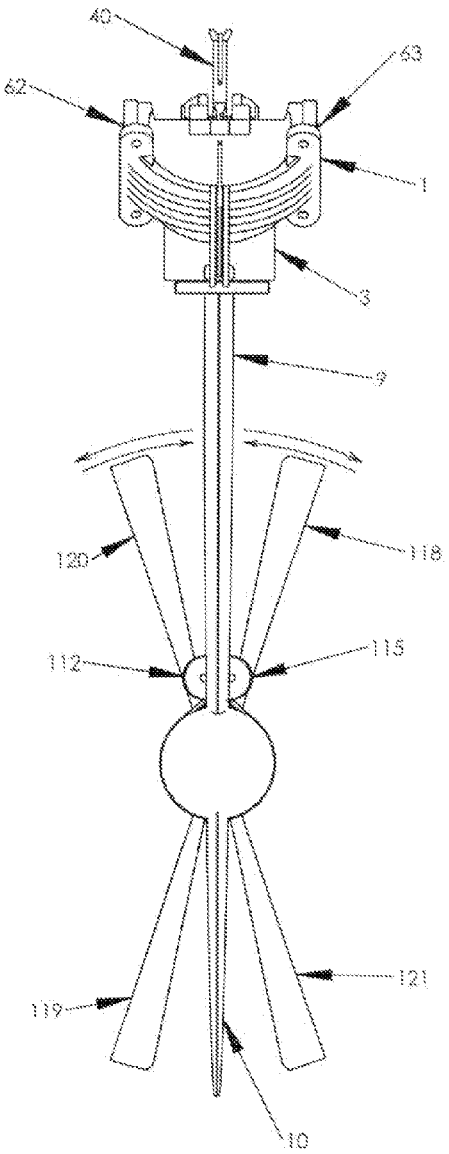
Figure 17:
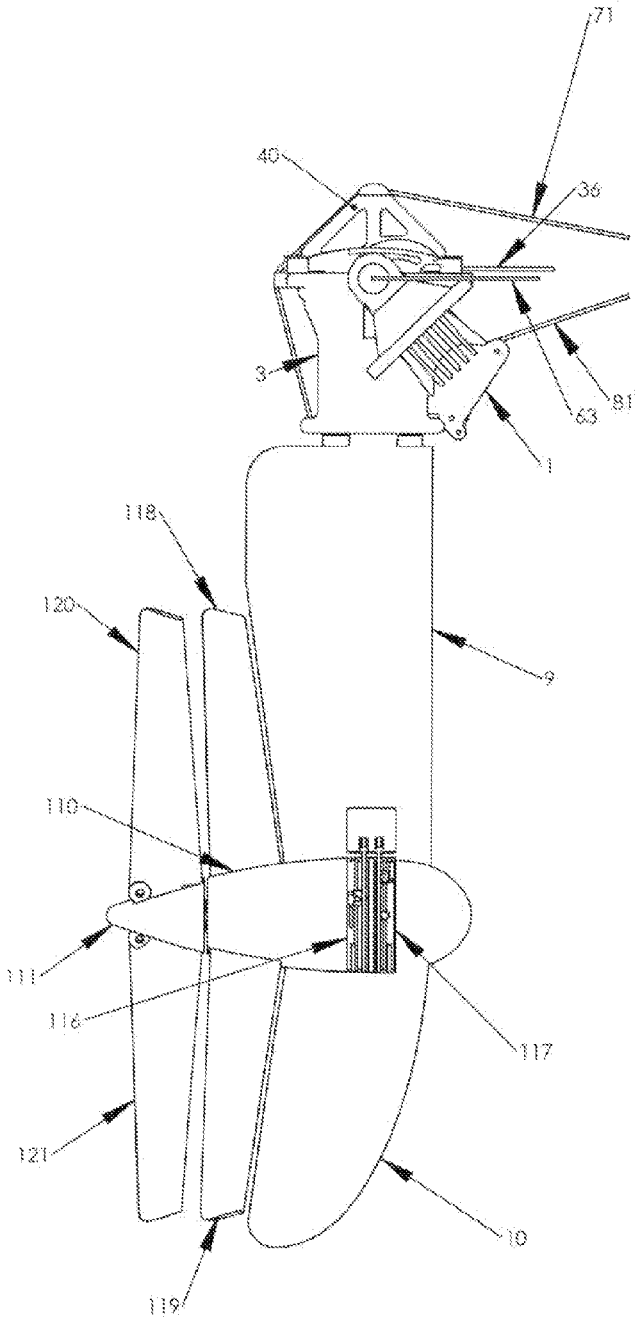
Figure 18:
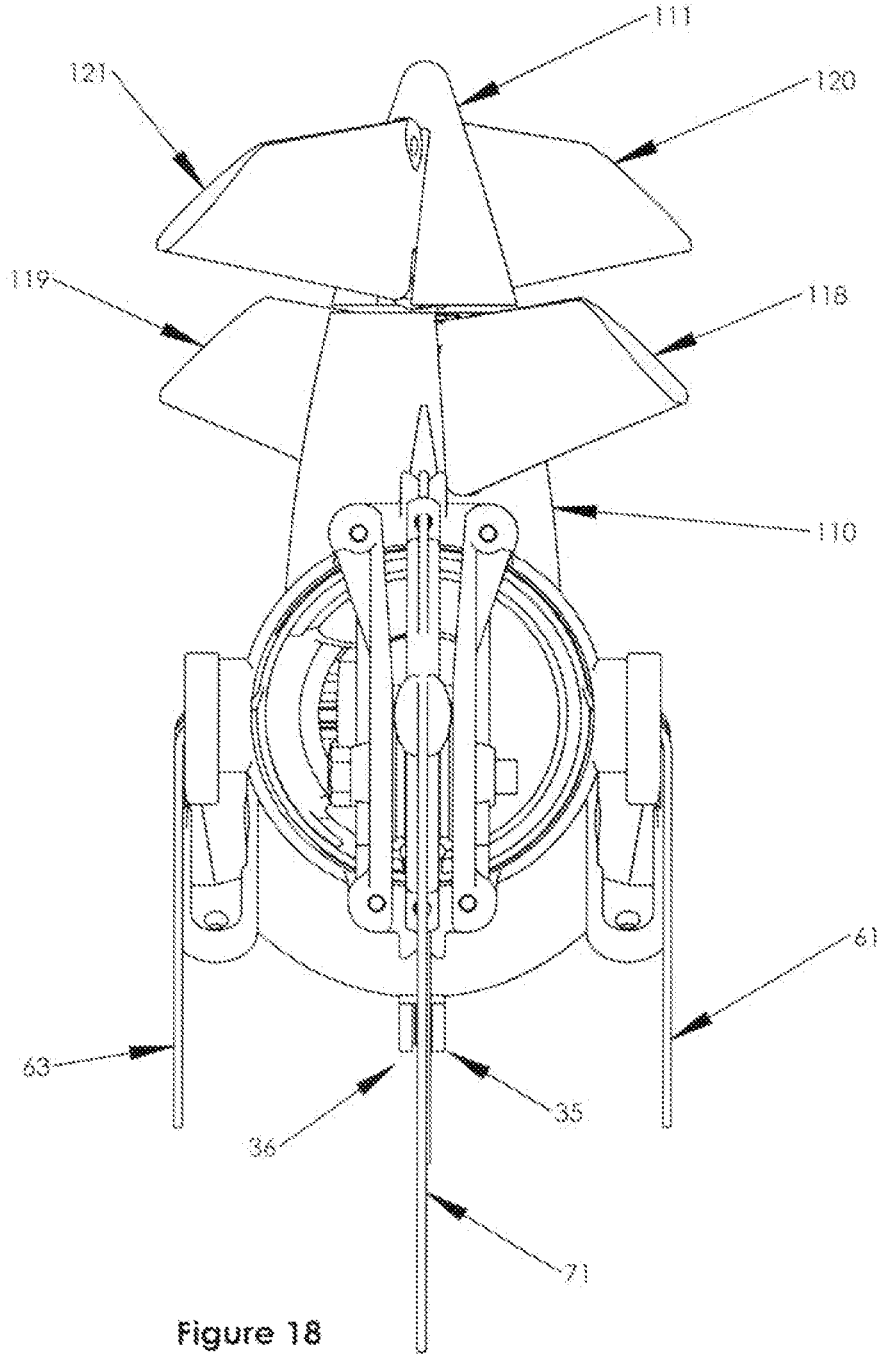
Figure 19:
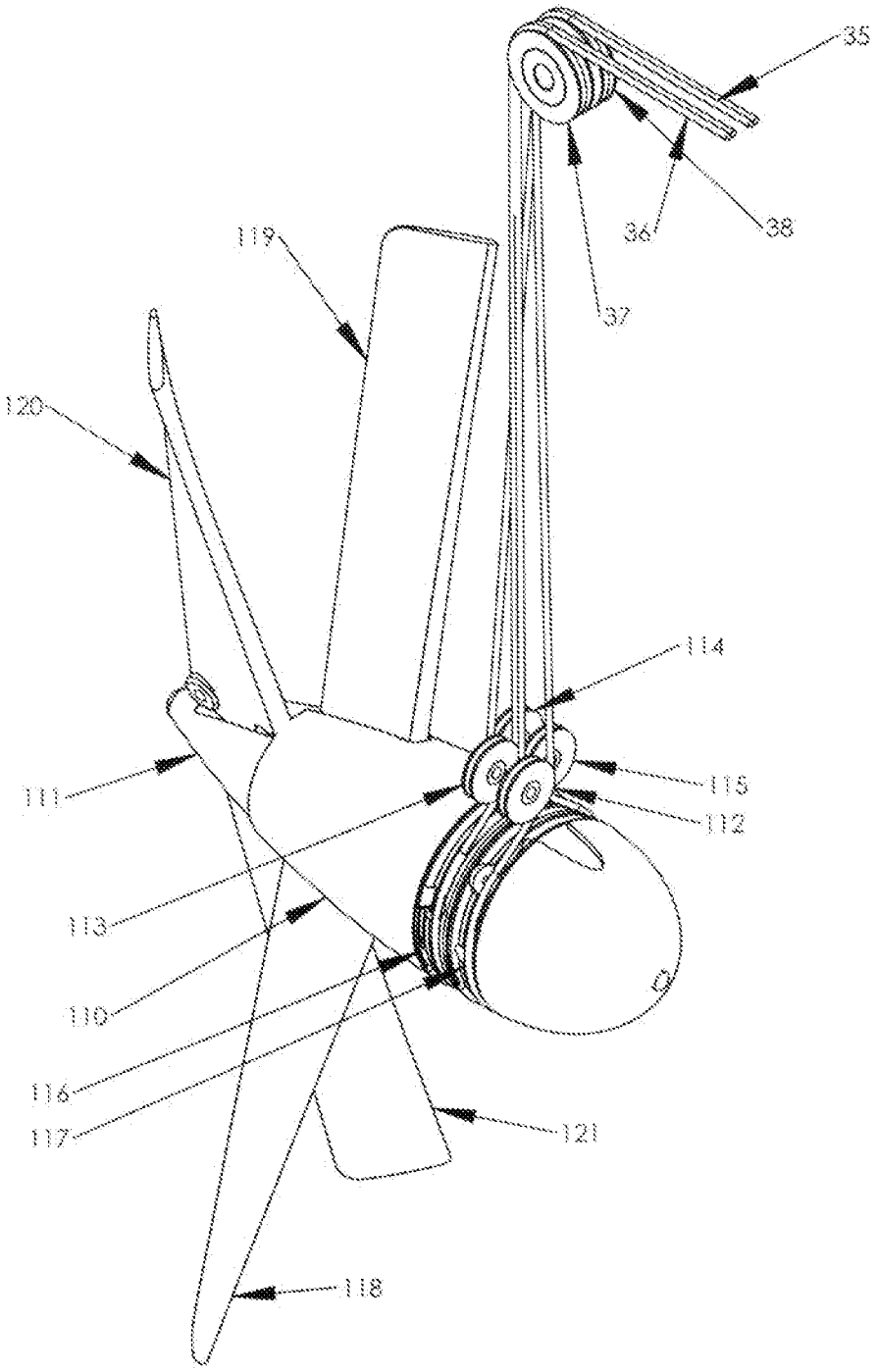

As shown in FIG. 15, the invention of FIGS. 1 to 14 is adapted for use on catamarans.

FIGS. 16, 17, 18 and 19 show another embodiment of this invention. The twin pairs of power cables now 35 and 36 come back to the remote drive and are turned down into the rudder 10 with the pulleys 37 and 38. The left power cable pair 35 is then split and one cable goes around turning block 114 and one goes around turning block 112. The right drive cable pair 36 splits and one cable goes around the turning block 113 and one goes around turning block 115. The four cables go around the two drums 116 and 117 in opposite directions so that when drive cable pair 35 is pulled drums 116 and 117 turn in opposite directions and when drive cable pair 36 is pulled the drums 116 and 117 turn in the opposite directions.

Drum 117 is connected to hub 111 and drum 116 is connected to hub 110. Hubs 111 and 110 rotate opposite each other with each stroke of pedals 31 and 32. Fins 118, 119, 120, 121 are flexible and assume the shape of propeller blade when forced through the water.

FIGS. 20, 21, 22, 23, 24, 25 and 26 show still another alternative embodiment of this invention in which human input power is transferred from the pedals 31 and 32 to the remote drive with hydraulic fluid (water) instead of tension cables. Force on the pedals 31 or 32 causes piston assemblies 91 or 92 to move forward. Movement of piston assemblies 91 or 92 causes increased pressure inside cylinders 93 and 94 and causes the water to move back to the remote drive in hose 95.

When pedal 31 or 32 moves back water is drawn into cylinder 93 or 94 through hose 96 or 97 through the floor of the watercraft 98.

The water travels down the rudder 9 through hose 95 and into the rotary valve 100. The rotary valve directs the water into the front of the crankshaft 104. Water passes through the crankshaft 104 and exits through the port 138. The water goes into the port 106 of the rotary valve 100. The water is directed to hose 102 which leads to the first of 3 cylinders 102 which is the power stroke. The water pressure forces the piston 103 down and turns crankshaft 104 through connecting rod 135 which turns the propeller 11 in the clockwise direction while viewing from the rear.

FIG. 24*b* shows the same section view but the propeller 11 and crankshaft 104 has been rotated 180 degrees and cylinder 102 is exhausting the water out through hose 101. The water passes back through port 106 of the rotary valve 100 and into the crankshaft 104. The water exits through port 105 in the crankshaft 104.

Rotary valve 100 has 2 other ports 107 and 108. These ports direct water to or from cylinders 109 and 130 through hoses 131 and 132 when these ports 107 and 108 line up with the ports 105 or 138 of the crankshaft 104. Water pressure acts on pistons 133 and 134 and turns the crankshaft 104 through connecting rods 136 and 137.

FIGS. 28, 29 and 30 show yet another alternative embodiment of this invention which uses an electric motor and battery for power and thrust. A power cord 90 comes from a battery 140, which preferably is carried just behind the cockpit 8 and goes forward to the throttle control 141 which is located in convenient location for the rider 30 to operate. The power cord 90 then goes back to the stern and then goes down the rudder 10 and to the electric gearmotor 88. A clutch bearing 87 allows torque to go from the gearmotor 88 to the propeller assembly 11, but does not allow the torque to go into the gearmotor 88. A seal 89 prevents water from entering the gearmotor 88.

The electric motor can also be used in conjunction with the human powered embodiments of FIGS. 1 to 25.

What is claimed:

1. A human powered watercraft comprising a bow and a stern, a deck, a rudder at the stern and a cockpit intermediate the bow and the stern further comprising:

power means carried by the watercraft providing a source of propulsive power comprising pedals for receiving human input force;

a seating area in said cockpit aft of said pedals for carrying a human operator;

said rudder being freely rotatable left and right and carried about a vertical axis by a connection to said stern and having in proximity to the lower extremity of said rudder, propulsion means for propelling the watercraft comprising a propeller or fins;

said rudder being retractable about said connection about an axis generally transverse to the stern of said watercraft, said rudder being rotatable on said connection about said axes to be stored above and lay essentially flat on the deck of said watercraft aft of said seating area while remaining connected to the stern of said watercraft; and a drive train connecting said source of propulsive power with the bottom of said rudder to drive said propulsion means.

2. The human powered watercraft of claim 1 further comprising:

a steering handle located adjacent said seating area;

ropes connecting said steering handle to said rudder so that the operator can cause said rudder to freely rotate about said vertical axis to steer, said ropes allowing said rudder to be retractable; and said ropes pass approximately through the center of rotation for retraction of said rudder thereby allowing steering to occur at any angle of retraction of said rudder.

3. The human powered watercraft of claim 1 wherein said pedals are adapted to move back and forth with a stepping motion.

4. Then human powered watercraft of claim 1 wherein said fins are adapted to assume the shape of a propeller blade.

5. The human powered watercraft of claim 1 wherein the craft is a catamaran.

6. The human powered watercraft of claim 1 wherein the craft is a kayak.

7. A human powered watercraft comprising a bow and a stern, a deck, a rudder at the stern and a cockpit intermediate the bow and the stern further comprising:

power means carried by the watercraft providing a source of propulsive power comprising pedals for receiving human input force;

a seating area in said cockpit aft of said pedals for carrying a human operator;

said rudder being freely rotatable left and right and carried about a vertical axis by a connection to said stern and having in proximity to the lower extremity of said rudder, propulsion means for propelling the watercraft comprising at least one pair of flexible fins extending below the water line and carried by said rudder in proximity to the lower end of said rudder, each of said fins adapted to rotate about an axis parallel to the direction of thrust;

said rudder being retractable up to 270° about said connection about an axis generally transverse to the stern of said watercraft and being rotatable on said connection to turn 90° about said vertical axis to be stored above and lay essentially flat on the deck of said watercraft aft of said seating area while remaining connected to the stern of said watercraft; and a drive train connecting said source of propulsive power with the bottom of said rudder to drive said rotatable flexible fins.

8. The human powered watercraft of claim 7 wherein said rudder extends below said propulsion means for protection of said fins.

9. A human powered watercraft comprising a bow and a stern, a deck, a rudder at the stern and a cockpit intermediate the bow and the stern further comprising:

power means carried by the watercraft providing a source of propulsive power comprising pedals for receiving human input force;

a seating area in said cockpit aft of said pedals for carrying a human operator;

said rudder being freely rotatable left and right and carried about a vertical axis by a connection to said stern and having in proximity to the lower extremity of said rudder, propulsion means for propelling the watercraft comprising a propeller;

said rudder being retractable about said connection about an axis generally transverse to and fixed to the stern of said watercraft, said rudder being rotatable on said connection about said axis to be stored above and lay essentially flat on the deck of said watercraft aft of said seating area while remaining connected to the stern of said watercraft; and a drive train connecting said source of propulsive power with the bottom of said rudder to drive said propeller.

10. The human powered watercraft of claim 9 wherein said rudder extends below said propulsion means for protection of said propeller.

11. The human powered watercraft of claim 9 wherein said propeller is mounted on a horizontal propeller shaft carried by the rudder.

12. A human powered watercraft having a bow and a stern, a deck, a rudder at the stern and a cockpit intermediate the bow and the stern comprising:

power means carried by the watercraft providing sources of propulsive power comprising pedals for receiving human input force;

a seating area in said cockpit aft of said pedals for carrying a human operator;

said rudder being freely rotatable left and right and carried about a vertical axis by a connection to said stern and having in proximity to the lower extremity of said rudder, propulsion means for propelling the watercraft comprising at least one pair of flexible fins extending below the water line and carried by said rudder in proximity to the lower end of said rudder, each of said fins rotatable to rotate about an axis parallel to the direction of thrust;

said rudder being retractable about said connection about an axis generally transverse to the stern of said watercraft, said rudder being rotatable on said connection about said axes to be stored above and lay essentially flat on the deck of said watercraft while remaining connected to the stern of said watercraft aft of said seating area;

a drive train connecting said sources of propulsive power with the bottom of said rudder to drive said flexible fins;

said watercraft carrying a battery forward of the stern;

an electric motor carried by said rudder;

said battery configured to supply electrical power to said electric motor; and said electric motor configured to provide driving force to said at least one pair of rotatable flexible fins.

13. The human powered watercraft of claim 12 wherein said rudder extends below said propulsion means for protection of said fins.

14. A human powered watercraft having a bow and a stern, a deck, a rudder at the stern and a cockpit intermediate the bow and the stern comprising:

power means carried by the watercraft providing sources of propulsive power comprising pedals for receiving human input force;

a seating area in said cockpit aft of said pedals for carrying a human operator;

said rudder being freely rotatable left and right and carried about a vertical axis by a connection to said stern and having in proximity to the lower extremity of said rudder, propulsion means for propelling the watercraft comprising a propeller;

said rudder being retractable about said connection about an axis generally transverse to and fixed to the stern of said watercraft, said rudder being rotatable on said connection about said axes to be stored above and lay essentially flat on the deck of said watercraft while remaining connected to the stern of said watercraft aft of said seating area;

a drive train connecting said sources of propulsive power with the bottom of said rudder to drive said propeller;

said watercraft carrying a battery forward of the stern;

an electric motor carried by said rudder;

said battery configured to supply electrical power to said electric motor; and means associated with said electric motor configured to provide driving force to said propeller.

15. The human powered watercraft of claim 14 wherein said rudder extends below said propulsion means for protection of said propeller.

* * * * *